United States Patent [19]

Harris et al.

[11] Patent Number: 4,786,023

[45] Date of Patent: Nov. 22, 1988

[54] DRAFTING IMPLEMENT HOLDER

[76] Inventors: Leverett D. Harris, 26 Madison St., New York, N.Y. 10038; George Spector, 233 Broadway RM 3815, New York, N.Y. 10007

[21] Appl. No.: 87,027

[22] Filed: Aug. 19, 1987

[51] Int. Cl.[4] ..... A47F 5/00

[52] U.S. Cl. ..... 248/309.1; 248/311.2

[58] Field of Search ..... 248/309.1, 309.2, 309.3, 248/309.4, 311.2, 2, 220.2; 297/194; 108/26

[56] References Cited

U.S. PATENT DOCUMENTS

| | | | |
|---|---|---|---|
| 2,698,155 | 12/1954 | Bowman | 248/311.2 |
| 2,912,205 | 11/1959 | Toune | 248/311.2 X |
| 2,926,879 | 3/1960 | Dietrich | 248/311.2 |
| 3,273,846 | 9/1966 | De Mare | 248/231.7 |
| 3,987,993 | 10/1976 | Hopkins | 248/311.2 X |
| 4,036,463 | 7/1977 | Hopkins et al. | 248/309.1 |
| 4,503,981 | 3/1985 | Coronado | 248/454 X |
| 4,697,780 | 10/1987 | Wenkman et al. | 248/311.2 X |

*Primary Examiner*—Ramon O. Ramirez

[57] ABSTRACT

A drafting implement holder is provided and consists of a receptacle for holding the drafting implements which is attached to the edge of a table top of a drafting table by a mounting structure to maintain the receptacle in a substantially vertical position regardless of the angular position of the table top.

4 Claims, 1 Drawing Sheet

DRAFTING IMPLEMENT HOLDER

BACKGROUND OF THE INVENTION

The instant invention relates generally to holders and more specifically it relates to a drafting implement holder.

Numerous holders have been provided in prior art that are adapted to be affixed to structures for holding various objects therein. For example, U.S. Pat. Nos. 2,926,879; 3,273,846 and 4,503,981 all are illustrative of such prior art. While these units may be suitable for the particular purpose to which they address, they would not be as suitable for the purposes of the present invention as heretofore described.

SUMMARY OF THE INVENTION

A primary object of the present invention is to provide a drafting implement holder that will overcome the shortcomings of the prior art devices.

Another object is to provide a drafting implement holder that is attached to the edge of a drafting table which will always remain in an upright position with respect to the angle of the drafting table.

An additional object is to provide a drafting implement holder in which the receptacle is rotatably and slideably affixed to a track on edge of the drafting table and can be quickly removed from the track.

A further object is to provide a drafting implement holder that is simple and easy to use.

A still further object is to provide a drafting implement holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
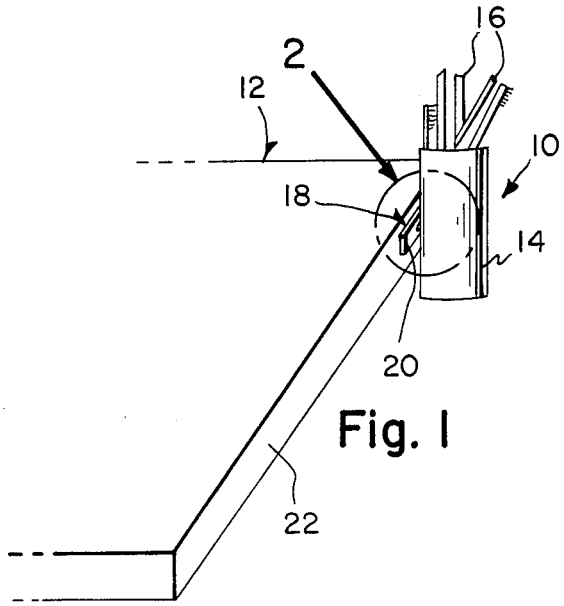
FIG. 1 is a perspective view of a drafting table with the invention attached to the edge of the table top.
Figure 2:
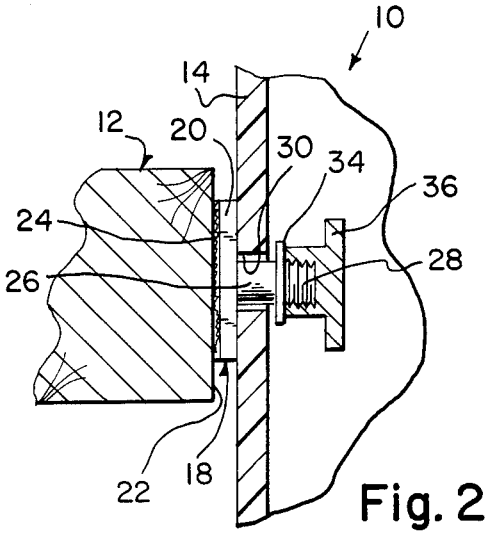
FIG. 2 is an enlarged cross sectional view as indicated by numeral 2 in FIG. 1.

Turning now descriptively to the drawings, in which similar reference characters denote similar elements throughout the several views, FIGS. 1 and 2 illustrate a drafting implement holder 10 especially suitable for mounting to an angularly adjustable table top 12 of a drafting table. The holder 10 consists of a receptacle 14 for holding drafting implements 16 therein. A structure 18 is provided for mounting the receptacle 14 to one edge 20 of the angularly adjustable table top 12 of the drafting table so as to maintain the receptacle 14 in a substantially vertical position regardless of the angular position of the table top 12.

As best seen in FIG. 2 the mounting structure 18 includes a bracket 20 attached to the edge 22 of the table top 12 by adhesive 24 or other fasteners (not shown). A stud 26 is affixed to the bracket 20 so as to extend outwardly therefrom and has a threaded free end 28. The receptacle 14 has an aperture 30 therethrough so as to be received onto the stud 26. An internally threaded stop washer 34 is adjustable threaded onto the threaded free end 28 of the stud 26. An internally threaded cap 36 is threaded onto the threaded free end 28 of the stud 26 against the stop washer 34 to keep the stop washer 34 thereon and allows the receptacle 14 to maintain the substantially vertical position.

Figure 3:
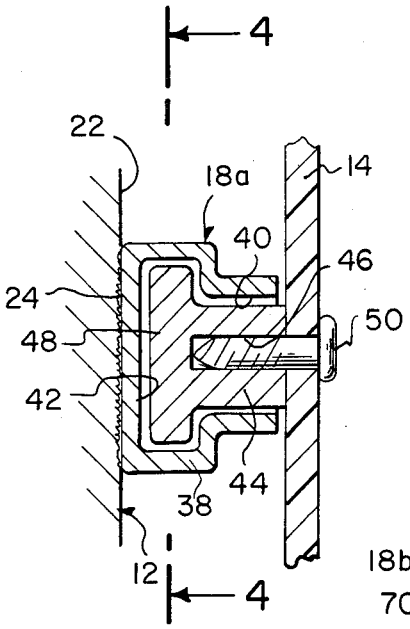
FIG. 3 is an enlarged cross sectional view similar to FIG. 2 showing a modification.
Figure 4:
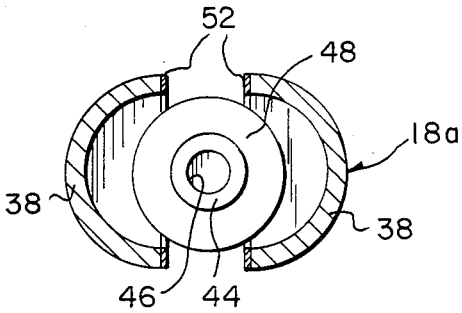
FIG. 4 is a cross sectional view taken along line 4—4 in FIG. 3 showing the seal member between the split in half support bracket.

FIG. 3 shows another type of mounting structure 18a that includes a circular support bracket 38 that has a hollow chamber 40 with enlarged portion 42 within. The bracket 38 is attached at 24, in a similar manner as bracket 20, to the edge 22 of the table top 12. A stud member 44 that has a socket 46 and enlarged circular head 48 is rotatable within the bracket 38. A cotter pin 50 extends through the receptacle 14 and into the socket 46 of the stud member 44 allowing the receptacle 14 to maintain the substantially vertical position. In FIG. 4 the support bracket 38 is shown axially split in half with a seal member 52 therebetween so that the stud member 44 can be inserted and removed therefrom.

Figure 5:
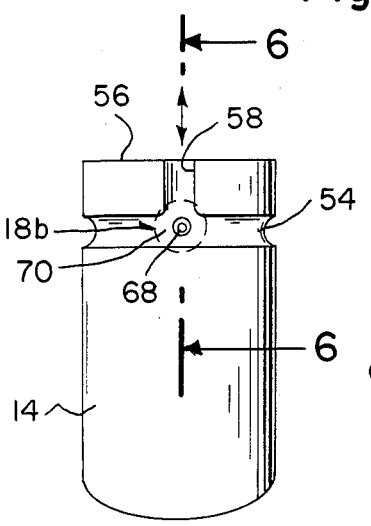
FIG. 5 is an elevational view of the receptacle showing another modification whereby the receptacle can be quickly removed from the bracket.
Figure 6:
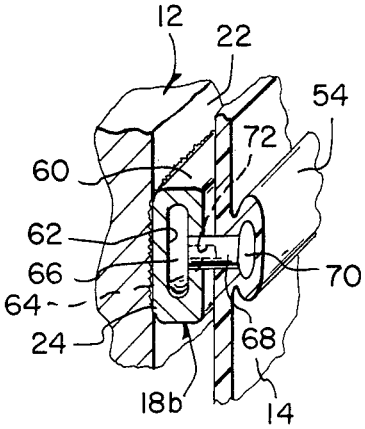
FIG. 6 is a perspective cross sectional view taken along line 6—6 in FIG. 5 showing the receptacle rotatably and slideably affixed to the bracket.

FIGS. 5 and 6 show still another type of mounting structure 18b. The receptacle 14 has an exterior annular groove 54 formed and located near upper edge 56 thereof with a vertical exterior groove 58 extending between the annular groove 54 and the upper edge 56. An elongated support bracket 60 that has a hollow chamber 62 within is attached at 24, in a similar manner as brackets 20 and 38 to the edge 22 of the table top 12. A threaded stud 64 that has an enlarged circular head 66 is inserted and slideable within the chamber 62 of the bracket 60 with the stud 64 extending outwardly therefrom. A plug 68 that has an enlarged circular head 20 and threaded socket 72 threads upon the threaded stud 64 whereby the vertical groove 58 of the receptacle 14 can be placed over the head 70 of the plug 68 and be manipulated until the head 70 of the plug 68 enters the annular groove 54 of the receptacle allowing the receptacle 14 to maintain the substantially vertical position.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A drafting implement holder especially suitable for mounting on an angularly adjustable table top of a drafting table, said holder comprising:

(a) a receptacle for holding drafting implements therein;

(b) means for mounting said receptacle to one edge of the angularly adjustable table top of the drafting table so as to maintain said receptacle in a substantially vertical position regardless of the angular position of the table top, wherein said mounting means includes:

(c) a bracket attached to the edge of the table top;

(d) a stud affixed to said bracket so as to extend outwardly therefrom, said stud having a threaded free end;

(e) said receptacle having an aperture therethrough, so as to be received onto said stud;

(f) an internally threaded stop washer inside said receptacle adjustably threaded onto the threaded free end of said stud; and (g) an internally threaded cap inside said receptacle threaded onto the threaded free end of said stud against said stop washer to keep said stop washer thereon allowing said receptacle to maintain the substantially vertical position.

2. A drafting implement holder especially suitable for mounting on an angularly adjustable table top of a drafting table, said holder comprising:

(a) a receptacle for holding drafting implements therein;

(b) means for mounting said receptacle to one edge of the angularly adjustable table top of the drafting table so as to maintain said receptacle in a substantially vertical position regardless of the angular position of the table top, wherein said mounting means includes:

(c) a circular support bracket having a hollow chamber with enlarged portion within, said bracket attached to the edge of the table top;

(d) a stud member having a socket and enlarged circular head within said stud member is rotatable with said bracket; and (e) a cotter pin extending through said receptacle and into the socket of said stud members allowing said receptacle to maintain the substantially vertical position.

3. A drafting implement holder as recited in claim 2, wherein said support bracket is axially split in half with a seal member therebetween, so that said stud member can be inserted and removed therefrom.

4. A drafting implement holder, especially suitable for mounting on an angularly adjustable table top of a drafting table, said holder comprising:

(a) a receptacle for holding drafting implements therein; and (b) means for mounting said receptacle to one edge of the angularly adjustable table top of the drafting table so as to maintain said receptacle in a substantially vertical position regardless of the angular position of the table top;

(c) said receptacle having an exterior annular groove formed and located near upper edge thereof with a vertical exterior groove extending between the annular groove and the upper edge;

(d) an elongated support bracket having a hollow chamber, within, said bracket attached to the edge of the table top;

(e) a threaded stud having an enlarged circular head inserted and slideable within the chamber of said bracket with said stud extending outwardly therefrom; and (f) a plug having an enlarged circular head and threaded socket to thread upon said threaded stud whereby the vertical groove of said receptacle can be placed over the head of said plug and be manipulated until the head of said plug enters the annular groove of said receptacle allowing said receptacle to maintain the substantially vertical position.

* * * * *